United States Patent [19]

Wisskirchen et al.

[11] Patent Number: 4,751,355

[45] Date of Patent: Jun. 14, 1988

[54] PUSHBUTTON SWITCH WITH COMBINED RESTORING-TACTILE FEEL SPRING

[75] Inventors: Klaus B. Wisskirchen; Klaus Hinze; Wolfgang Schulze; Reinhard L. Fricke; Alfred Heeb; Dieter Michalski, all of Berlin, Fed. Rep. of Germany

[73] Assignee: Rudolph Schadow GmbH, Berlin, Fed. Rep. of Germany

[21] Appl. No.: 70,985

[22] Filed: Jul. 8, 1987

[30] Foreign Application Priority Data

Jul. 9, 1986 [DE] Fed. Rep. of Germany ..... 3622962

[51] Int. Cl.[4] ..... H01H 13/52

[52] U.S. Cl. ..... 200/340; 200/159 R

[58] Field of Search ..... 200/340, 328, 159 R

[56] References Cited

U.S. PATENT DOCUMENTS

| | | | |
|---|---|---|---|
| 3,549,846 | 12/1970 | Francy | 200/340 |
| 3,964,593 | 6/1976 | Pointon | 200/340 |
| 4,153,829 | 5/1979 | Murata | 200/340 |
| 4,525,613 | 6/1985 | Butts | 200/340 |

*Primary Examiner*—Renee S. Luebke

*Attorney, Agent, or Firm*—T. L. Peterson

[57] ABSTRACT

A pushbutton switch having a contact actuating member movable in the direction of actuation, and a restoring spring which is loaded when the actuating member is depressed. A laterally resiliently deflectable detent element engages an inclined cam surface on the actuating member. When the member is depressed, the cam surface moves downwardly over the detent element causing the element to be laterally deflected, thereby releasing the detent mechanism. Thereafter, the actuating member is then free to move on against the force of the restoring spring.

8 Claims, 3 Drawing Sheets

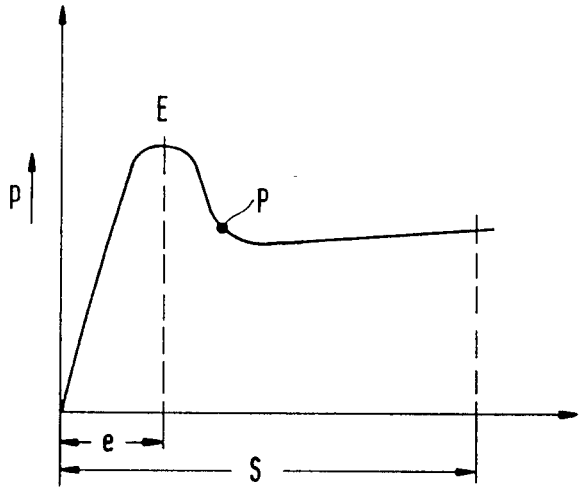
FIG. 1
FIG. 2
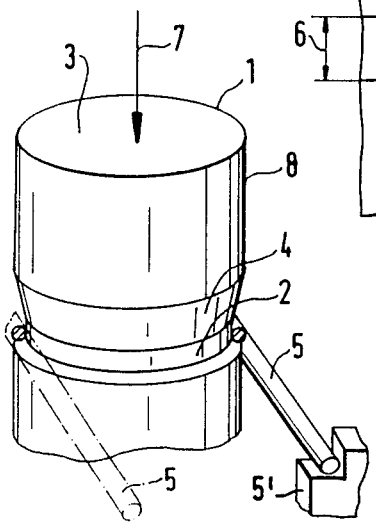
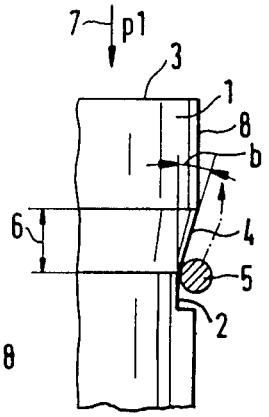
FIG. 3
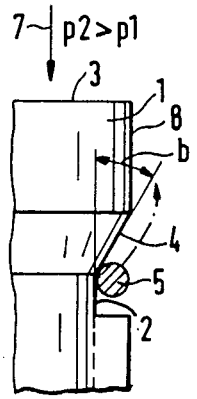
FIG. 4

PUSHBUTTON SWITCH WITH COMBINED RESTORING-TACTILE FEEL SPRING

BACKGROUND OF THE INVENTION

The present invention relates to a pushbutton switch and, more particularly, to a key switch.

In conventional pushbutton switches and in keys, it is known to actuate the movable member, which is designed as a plunger, against the force of a restoring spring. The spring force increases continuously with increasing pretravel. The same applies to pushbuttons with a hinged operating button. In the case of pushbutton switches with a relatively large pretravel, the actuation can be easily felt by the operator. However, this feel is lost if there is only a small pretravel of, for example, 1 to 2 mm, particularly if there is relative motion between the operator and switch, e.g., in a car, or if the switch is actuated with a glove.

It is therefore the object of the present invention to provide a short-travel pushbutton or key switch whose actuation can be clearly felt by the operator, with contact being made not immediately but after a fraction of the travel.

SUMMARY OF THE INVENTION

According to a principal aspect of the present invention, there is provided a pushbutton switch comprising a contact actuating member movable downwardly toward a switch contact to actuate the contact, and a restoring spring that biases the actuating member upwardly in a direction away from the contact. The actuating member has an external surface and an inwardly extending cam surface below the external surface. A laterally resiliently deflectable detent element engages the cam surface on the actuating member. The cam surface is shaped such that upon downward movement of the actuating member, the cam surface will slide over the detent element causing the element to deflect outwardly until the external surface of the member reaches said element, whereby the actuating member is in a released condition and is free to move further downwardly toward the contact against the force of the spring. The contact is located relative to the actuating member so as to be actuated thereby approximately at or shortly after the actuating member reaches said released condition. By this arrangement a distinct operating point is obtained because the initial operating force is considerably greater than the force required to press the actuating member all the way down. Thus, even is darkness, the operator can always feel whether the switch is actuated.

Further aspects and advantages of the invention will become apparent from the following description taken in connection with the accompanying drawings.

BRIEF DESCRIPTION OF THE DRAWINGS

FIG. 1 is a graph showing a typical switch-on characteristic of a switch in accordance with the invention;

FIG. 2 shows a contact actuating member with a detent spring and a circumferential cam surface according to one embodiment of the invention;

FIGS. 3 and 4 are fragmentary views of two actuating members similar to that shown in FIG. 2 with cam surfaces of different inclinations;

DESCRIPTION OF THE PREFERRED EMBODIMENTS

Figure 5:
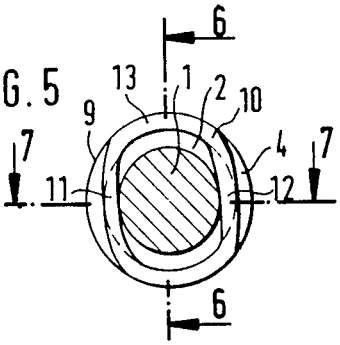
FIG. 5 is a transverse partial sectional view taken through the contact actuating member of a second embodiment of the present invention, in the plane of the cam surface on said member, wherein the restoring spring is designed to provide the detent spring.

In FIG. 1, s indicates the travel, i.e., the path of the contact actuating member, which is approximately 1 to 4 mm, and preferably 1 to 2 mm, and p indicates the operating force. In the first quarter of the travel of the actuating member, the increase in force is steep. After the releasing of the actuating member at the point E, the operating force drops sharply and then increases continuously in accordance with the spring constant of the restoring spring and, possibly, the friction of the detent spring at the actuating member. The switching point P is preferably located on the falling portion of the curve behind the releasing point E. The distance of travel e of the releasing point E is preferably about 3 to 30% of the travel s of the actuating member. However, the switching point P could be near the releasing point E, if desired, and the desired switch characteristic would be achieved.

In FIG. 2, a contact actuating member 1 designed as a cylindrical plunger, is provided with a circumferential recess 2, e.g., a groove, whose surface closest to the actuating side 3 is designed as an inclined cam surface 4. Preferably the surface has a frusto-conical configuration. In the normal position of the switch, a laterally extending spring wire 5 acting as a detent element engages one side of the groove 2. If desired, two wires 5 could be located on opposite sides of member 1, the second such wire being shown in dashed lines. The wire 5 is fixed at one end to a support 5'. The axial length 6 of the cam surface 4 is equal to the distance e up to the releasing point E of FIG. 1. If the actuating member 1 is depressed in the direction of the arrow 7, the former slides downward in a suitable guide in the pushbutton or key switch (not shown), while the spring wire 5 slides on the cam surface 4 and is deflected laterally outwardly. The force required to this end depends on the angle b of the cam surface 4, as shown in FIGS. 3 and 4 for two forces p1, p2, respectively, and on the force which is required to laterally deflect the wire 5.

After the cam surface 4 has passed downwardly below the wire 5, the actuating member 1 is released, and the wire 5 rests against the smooth outside cylindrical surface 8 of the actuating member 1. Thus, the high initial pressure is overcome; only the force of a restoring spring (not shown) and the friction acting between the wire 5 and the smooth outside surface 8 exists.

The cam surface 4 need not be a circumferential groove 2. It can also be formed by a suitable recess in the outside surface 8 or by a reduced cross section of the actuating member 1, as shown in dashed lines in FIG. 4.

Figure 6:
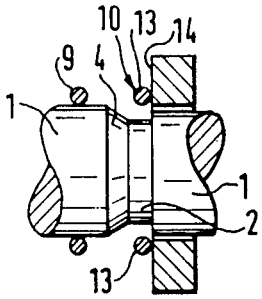
FIG. 6 is a sectional view taken along line 6—6 of FIG. 5.
Figure 7:
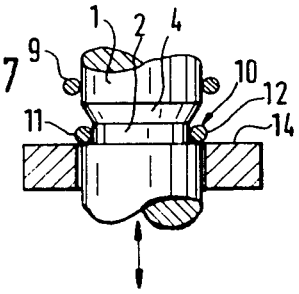
FIG. 7 is a sectional view taken along line 7—7 of FIG. 5.

Referring now to FIGS. 5 to 7, a particularly simple design to obtain the operating point is the use of the restoring spring 9 as the detent element, wherein the lowermost convolution 10 of a coil spring is deformed inwardly at two opposite portions 11, 12 or at only one portion 11 or 12, which engage against the cam surface 4, and releasing finally takes place as described above. The undeformed portions 13 of the convolution lie on a fixed bearing surface 14 of the switch. The inwardly deformed portions 11 and 12 may be slightly curved inwardly or outwardly, or may be straight-lined.

Figure 8:
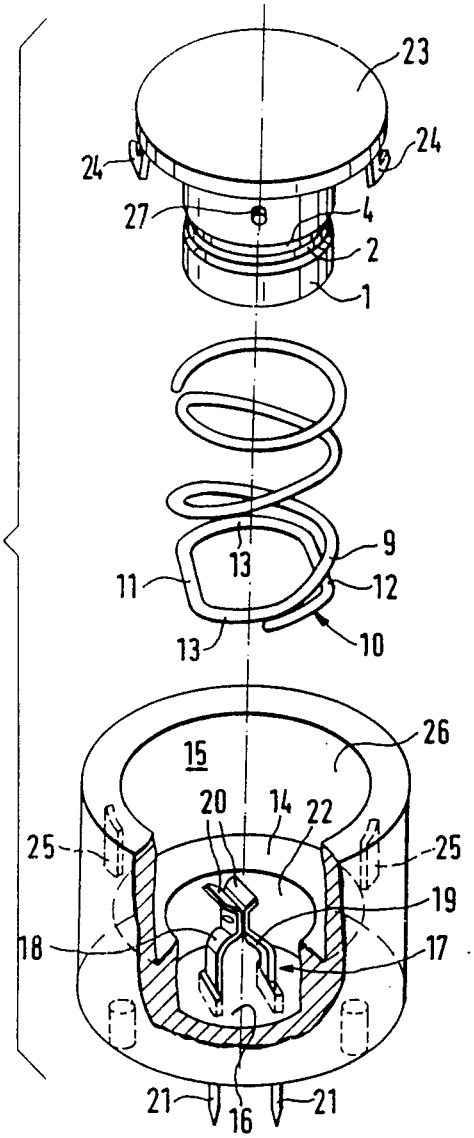
FIG. 8 is an exploded view of a pushbutton switch having a restoring spring like that shown in FIGS. 5–7.
Figure 14:
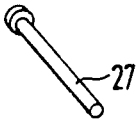
FIG. 14 shows the separating member of FIG. 8.

The use of such a restoring spring 9 in a pushbutton switch is best seen in FIG. 8, wherein the same reference numerals are used to designate like or corresponding parts as shown in FIGS. 5–7. In the bottom 16 of a socket-like housing 15, two touching contact springs 18, 19 with inclined surfaces 20 are mounted in a recess 17. The contact springs can be contacted from outside at the terminals 21.

The upper rim portion of the recess 17 serves as a fixed bearing 14 for the undeformed portions 13 of the lower convolution 10 of the restoring coil spring 9. The latter surrounds an actuating member 1 designed here as a hollow, cylindrical sliding shank. The actuating member 1 has a groove 2 which provides the cam surface 4 and is engaged by the inwardly deformed portions 11, 12 of the restoring spring 9.

The inside wall 22 of the recess 17 serves to slidably support the lower end of the actuating member 1. The member has a disk-shaped operating button 23 at its upper end. At the sides of the operating button 23, there are two locking lugs 24 which slidably engage corresponding vertical grooves 25 on the inside wall 26 of the housing 15.

The hollow, cylindrical actuating member 1 is traversed by an insulating separating member 27 which, after the actuating member overcomes the detent force, moves against the inclined surfaces 20 of the contact springs 18, 19, separating them as the actuating member is pressed on, thus breaking the contact. A contact spring set can also be opened in similar fashion.

Figure 9:
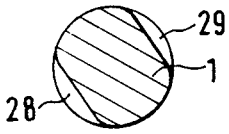
FIGS. 9 to 11 are transverse sectional views similar to FIG. 5 showing three different embodiments of the cam surface that may be used on the contact actuating member.
Figure 10:
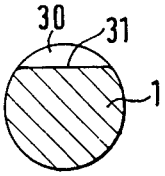
Figure 11:
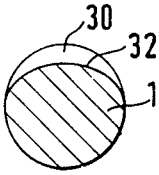

As indicated above, the groove 2 need not be circumferential; two depressions 28, 29 on opposite sides of the contact actuating member 1 as shown in FIG. 9 will be sufficient. The remaining cross section of the actuating member 1 is then approximately elliptic. If only one portion 11 or 12 of the lowermost convolution 10 of the spring is deformed inwardly, only one depression 30 is required. As shown in FIGS. 10 and 11, the depression can be formed by a straight or a curved wall portion 31 and 32, respectively.

Figure 12:
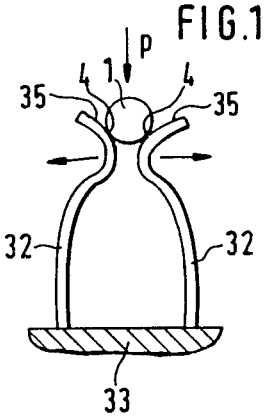
FIG. 12 schematically shows a further embodiment of the invention using two spring arms in the actuating member detent arrangement.
Figure 13:
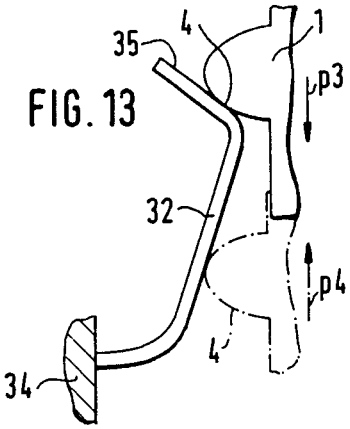
FIG. 13 schematically shows an additional embodiment of the invention using a laterally mounted spring arm in the detent arrangement.

The detent element, instead of being formed by a convolution of the restoring spring 9, may also be provided by at least one laterally deflectable, resilient arm 32 which can be attached, for example, to a bottom support 33 as shown in FIG. 12 or to a side support 34 as shown in FIG. 13. The arms 32 have inclined surfaces 35 which cooperate with a cam surface 4 on the actuating member 1.

As shown in FIGS. 12 and 13, the cam surfaces 4 may be curved outwardly, so that with an increasing travel s, the force to be exerted will become smaller. A very high initial actuation pressure can thus be obtained. In FIG. 13 two positions of the actuating member 1 are shown (the lower one in dashed lines). In the upper position the force p3 indicated by the arrow is high with respect to the force p4 of the lower position acting in the opposite direction and being the returning force.

Although several embodiments of the invention have been disclosed herein for purposes of illustration, it will be understood that various changes can be made in the form, details, arrangement and proportion of the various parts in such embodiments without departing from the spirit and scope of the invention as defined by the appended claims.

What we claim is:

1. A pushbutton switch comprising:

a contact actuating member movable in a first direction toward a switch contact to actuate said contact;

spring means biasing said member in a second direction opposite to said first direction away from said contact;

said member having an external surface and an inwardly extending cam surface adjacent to said external surface in said first direction;

said spring means comprising a coil spring having a convolution embodying a first portion deformed to provide a laterally resiliently deflectable detent element engaging said cam surface, and a second portion engaging a bearing surface adjacent to said member facing in said second direction;

said cam surface being shaped such that upon movement of said member in said first direction, said cam surface will slide over said detent element causing said element to deflect outwardly until said external surface of said member reaches said element whereby said member is in a released condition and is free to move further in said first direction toward said contact compressing said spring means; and said contact is located relative to said member so as to be actuated thereby approximately at or shortly after said member reaches said released condition.

2. A switch as set forth in claim 1 wherein:

said first portion of said convolution runs in an approximately straight line perpendicular to the direction of movement of said movable member.

3. A switch set as set forth in claim 1 wherein:

two opposite segments of said convolution are deformed inwardly to form said first portion.

4. A switch as set forth in claim 1 wherein:

said cam surface comprises a depression formed in the surface of said movable member.

5. A switch as set forth in claim 1 wherein:

said cam surface is formed by a circumferential groove in the movable member.

6. A switch as set forth in claim 1 wherein:

said cam surface has a frusto-conical configuration.

7. A switch as set forth in claim 1 wherein:

an actuating button is fixed to said actuating member;

said coil spring has a convolutiion engaging said button; and said bearing surface surrounds said member adjacent to said cam surface.

8. A switch as set forth in claim 1 wherein:

said external surface of said member is cylindrical; and said cam surface has a frusto-conical configuration which inclines in said second direction and outwardly.

* * * * *